US011097558B2

(12) United States Patent
Shinjo

(10) Patent No.: US 11,097,558 B2
(45) **Date of Patent: *Aug. 24, 2021**

(54) PRINTING METHOD AND PRINTING APPARATUS

(71) Applicant: CANON KABUSHIKI KAISHA, Tokyo (JP)

(72) Inventor: Ryoya Shinjo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/832,968

(22) Filed: Mar. 27, 2020

(65) Prior Publication Data

US 2020/0223235 A1 Jul. 16, 2020

Related U.S. Application Data

(63) Continuation of application No. 15/258,904, filed on Sep. 7, 2016, now Pat. No. 10,632,764.

(30) Foreign Application Priority Data

Sep. 30, 2015 (JP) ..... JP2015-194404

(51) Int. Cl.
*B41J 11/00* (2006.01)
*B41J 2/045* (2006.01)

(52) U.S. Cl.
CPC ..... *B41J 11/0065* (2013.01); *B41J 2/04558* (2013.01); *B41J 2/04586* (2013.01); *B41J 11/008* (2013.01); *B41J 11/0095* (2013.01)

(58) Field of Classification Search
CPC .... B41J 11/0065; B41J 11/008; B41J 29/393; B41J 11/0095; B41J 11/003; G06K 15/4065
See application file for complete search history.

(56) References Cited

U.S. PATENT DOCUMENTS

| | | | |
|---|---|---|---|
| 7,059,785 | B2 | 6/2006 | Kato et al. |
| 7,334,860 | B2 | 2/2008 | Mitsunaga et al. |
| 7,401,881 | B2 | 7/2008 | Endo |
| 7,506,947 | B2 | 3/2009 | Uchida |
| 7,708,366 | B2 | 5/2010 | Endo |
| 7,710,594 | B2 | 5/2010 | Kato et al. |
| 7,961,347 | B2 | 6/2011 | Kato et al. |

(Continued)

FOREIGN PATENT DOCUMENTS

| | | | |
|---|---|---|---|
| CN | 1761567 | A | 4/2006 |
| CN | 1874894 | A | 12/2006 |

(Continued)

OTHER PUBLICATIONS

Search Report dated Mar. 20, 2017, in European Patent Application No. 16001972.5.

(Continued)

*Primary Examiner* — Thinh H Nguyen
(74) *Attorney, Agent, or Firm* — Venable LLP

(57) ABSTRACT

A printing method includes printing an image on a sheet with a printhead, detecting an edge of the printed image in a widthwise direction of the sheet, and performing borderless printing, based on the detection result, to make a margin amount in the widthwise direction become not more than a predetermined value so as to prevent the image from being formed outside of the sheet in the widthwise direction.

24 Claims, 15 Drawing Sheets

(56) References Cited

U.S. PATENT DOCUMENTS

| | | | |
|---|---|---|---|
| 8,287,080 | B2 | 10/2012 | Endo |
| 8,368,949 | B2 | 2/2013 | Kato et al. |
| 8,740,345 | B2 | 6/2014 | Masuda |
| 8,814,305 | B2 | 8/2014 | Mizes et al. |
| 9,387,710 | B2 | 7/2016 | Shinjo et al. |
| 2005/0200680 | A1 | 9/2005 | Uchida |
| 2007/0146740 | A1 | 6/2007 | Yoshida |
| 2009/0102874 | A1 | 4/2009 | Ito |
| 2013/0002749 | A1 | 1/2013 | Masuda |
| 2014/0146102 | A1 | 5/2014 | Mizes et al. |

FOREIGN PATENT DOCUMENTS

| | | | |
|---|---|---|---|
| JP | 2002-137509 | A | 5/2002 |
| JP | 2002-331648 | A | 11/2002 |
| JP | 2004-058366 | A | 2/2004 |
| JP | 2004-130627 | A | 4/2004 |
| JP | 2004-314410 | A | 11/2004 |
| JP | 2005-047026 | A | 2/2005 |
| JP | 2005-125675 | A | 5/2005 |
| JP | 2006-231612 | A | 9/2006 |
| JP | 2006-289785 | A | 10/2006 |
| JP | 2009-078511 | A | 4/2009 |
| JP | 1434143 | B2 | 3/2010 |
| JP | 2010-089459 | A | 4/2010 |
| JP | 2010-173069 | A | 8/2010 |
| WO | 03/026277 | A1 | 3/2003 |
| WO | 2004/091917 | A1 | 10/2004 |

OTHER PUBLICATIONS

Office Action dated Jul. 3, 2018, in Chinese Patent Application No. 201610866015.5.

Office Action dated Oct. 15, 2018, in Japanese Patent Application No. 2015-194404.

Office Action dated May 31, 2019, in Japanese Patent Application No. 2015-194404.

Office Action dated Jul. 2, 2019, in Korean Patent Application No. 10-2016-0121798.

Office Action dated Jan. 30, 2020, in Korean Patent Application No. 10-2016-012798.

Office Action dated Nov. 20, 2020, in Chinese Patent Application No. 202010306505.6.

PRINTING METHOD AND PRINTING APPARATUS

BACKGROUND OF THE INVENTION

Field of the Invention

The present invention relates to a printing method and a printing apparatus.

Description of the Related Art

In, for example, printing a photographic image, borderless printing is known, which prints an image on a sheet without providing any margin on the sheet. There has been proposed a technique of setting a printing range beyond a sheet when performing borderless printing by using an inkjet printing apparatus. However, since ink is discharged to the outside of the sheet, this becomes a factor that leads to stain on a peripheral portion and wasteful ink consumption.

As a measure against this problem, Japanese Patent No. 4434143 discloses a technique of minimizing the amount of ink discharged to the outside of a sheet by detecting an edge of the sheet and setting a printing start position or printing end position at an outside position near the detected edge. In addition, Japanese Patent Laid Open No. 2006-231612 discloses a technique of preventing stain on a peripheral portion by providing a platen with grooves which receive ink. These grooves are provided at positions corresponding to edges of the platen with reference to a main sheet size.

In both the techniques disclosed in Japanese Patent No. 4434143 and Japanese Patent Laid-Open No. 2006-231612, ink is discharged to the outside of a sheet, and hence ink is wasted. That is, there room for improvement in terms of reducing the amount of wasted printing material.

SUMMARY OF THE INVENTION

The present invention provides a technique of performing borderless printing while reducing the amount of wasted printing material.

According to an aspect of the present invention, there is provided a printing method comprising: printing an image on a sheet with a printhead; detecting an edge of the printed image in a widthwise direction of the sheet; and performing borderless printing, based on the detection result, to make a margin amount in the widthwise direction become not more than a predetermined value so as to prevent the image from being formed outside of the sheet in the widthwise direction.

Further features of the present invention will become apparent from the following description of exemplary embodiments (with reference to the attached drawings).

DESCRIPTION OF THE EMBODIMENTS

First Embodiment

Figure 1:
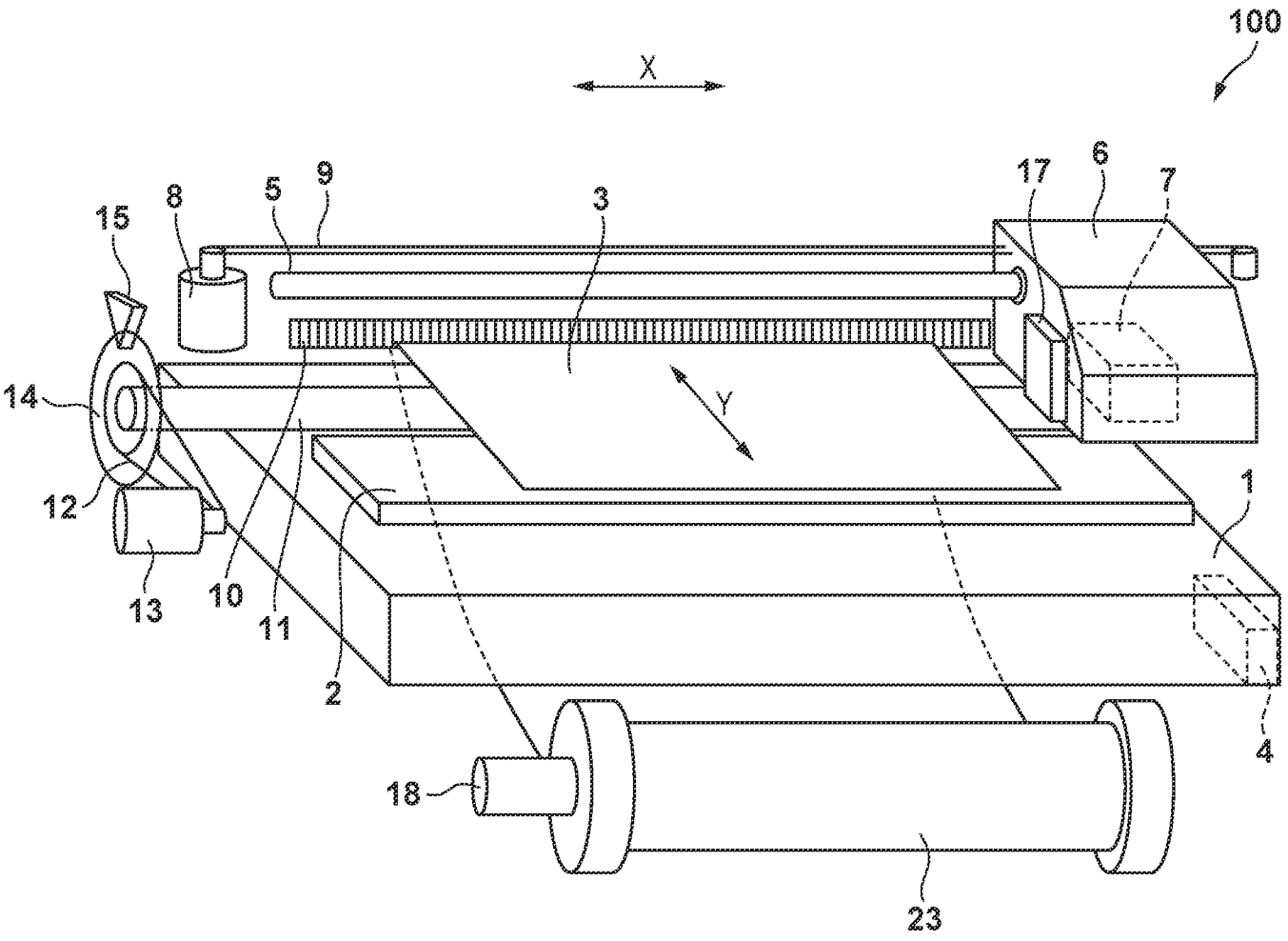
FIG. 1 is a perspective view of a printing apparatus according to an embodiment of the present invention.
Figure 2:
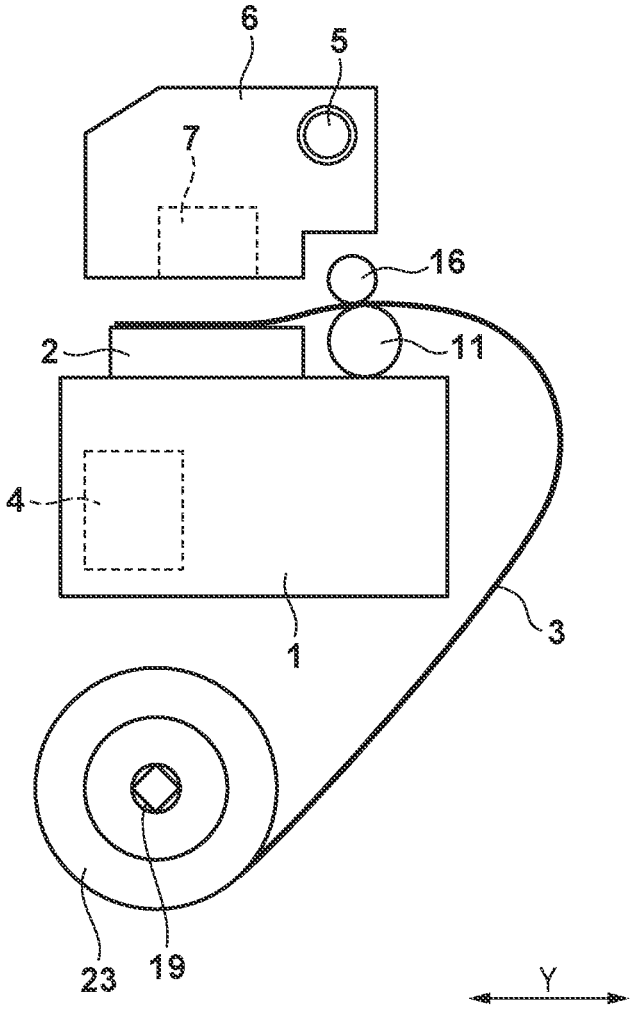
FIG. 2 is a side view of part of the printing apparatus in FIG. 1.

FIG. 1 is a perspective view of a printing apparatus 1 according to an embodiment of the present invention. FIG. 2 is a side view of part of the printing apparatus 1. The printing apparatus 1 is an inkjet printing apparatus (printer) which prints an image on a sheet 3 as a printing medium. Referring to FIGS. 1 and 2, an arrow X indicates the main scanning direction, which is the widthwise direction of the sheet 3, and an arrow Y indicates the sub-scanning direction, which is the conveying direction of the sheet 3. The conveyance source side and the conveyance destination side are sometimes called the upstream side the downstream side, respectively, with reference to the conveying direction of the sheet 3.

Note that "printing" includes not only forming significant information such as characters and graphic patterns but also forming images, designs, patterns, and the like, regardless of whether they are significant or insignificant, on printing media in a wide sense or processing media. That is, there is no limitation on whether something printed is visualized to be perceived by human vision. In addition, printing media may include cloth and plastic films as well as paper.

<Overview of Apparatus>

Although this embodiment will exemplify a serial type inkjet printing apparatus, the present invention can also be applied to a line-type inkjet printing apparatus. In addition, the present invention can also be applied to printing apparatuses of types other than inkjet printing apparatuses.

A printing apparatus 100 includes a housing 1. The housing 1 accommodates a sheet 3 as a roll sheet 23. Note that a printing medium may be a cut sheet. The roll sheet 23 is wound around a rotatably supported feed spool 18. The feed spool 18 is provided with a torque limiter 19 which brakes the rotation of the feed spool. The torque limiter 19 applies tension on the sheet 3 pulled out of the roll sheet 23.

The printing apparatus 100 includes a conveying mechanism for the sheet 3. The conveying mechanism includes a convey roller 11, a pinch roller 16 (not shown in FIG. 1), and a driving mechanism which rotates the convey roller 11. The pinch roller 16 comes into tight contact with the convey roller 11 and rotates following the rotation of the convey roller 11. The driving mechanism includes a conveyance motor 13 as a driving source and a transmission mechanism for transmitting the driving force of the conveyance motor 13 to the convey roller 11. The transmission mechanism is a belt transmission mechanism including a belt 12, but may be another type of transmission mechanism.

The printing apparatus 100 includes a sensor which detects the rotation amount of the convey roller 11. The sensor is a rotary encoder including a circular film 14 provided on the shaft of the convey roller 11 and a reading unit 15 which reads the circular film 14. A circumferential encoder pattern is drawn on the circular film 14. The reading unit 15 reads the encoder pattern optically, magnetically, or mechanically.

The printing apparatus 100 includes a printhead 7 which discharges ink to print an image on the sheet 3. The printhead 7 can print an image by discharging a plurality of types of inks, and is provided with a nozzle group for each type of ink. Ink types include different types of colors, pigments, dyes, and the like. It is possible to use, as the printhead 7, one of printheads based on various types of inkjet schemes such as a scheme using heating elements and a scheme using piezoelectric elements.

The printhead 7 is mounted on a carriage 6. The carriage 6 moves to reciprocate in a main scanning direction X. The moving mechanism of the carriage 6 includes a main rail 5 and a driving mechanism. The main rail 5 extends in the main scanning direction X and movably supports the carriage 6. The driving mechanism includes a carriage motor 8 as a driving source and a transmission mechanism which transmits the driving force of the carriage motor 8 to the carriage 6. The transmission mechanism is a belt transmission mechanism including a belt 9, but may be another type of transmission mechanism. The belt 9 is looped around a pair of pulleys. The carriage 6 is fixed to part of the belt 9. As the belt 9 runs, the carriage 6 moves.

The printing apparatus 100 includes a linear encoder which detects the position of the carriage 6 in the main scanning direction X. Detecting the position of the carriage 6 in the main scanning direction X can control the printing position (ink discharging position) of the printhead 7. The linear encoder includes an encoder pattern 10 and a reading unit (not shown in FIGS. 1 and 2; a reading unit 10*a* in FIG. 6) which reads the pattern optically, magnetically, or mechanically. The encoder pattern 10 is fixed to the housing 1 and extends in the main scanning direction X. The reading unit 10*a* is mounted on the carriage 6.

The printing apparatus 100 includes a sensor unit 17. The sensor unit 17 is mounted on the carriage 6, and reads the sheet 3 or an image printed on the sheet 3 upon movement of the carriage 6. Alternatively, in particular if the printing apparatus is not of the serial type but such as a full-line type printing apparatus, one or more sensor(s) can be mounted at one or more predetermined position(s) in the printing apparatus, such as on or downstream of the print head of a full-line type printing apparatus.

One of the functions of the sensor unit 17 is to detect the position of an edge portion of the sheet 3 in the main scanning direction X. Another function is to detect the position of an image recorded on the sheet 3. The position of an image can be detected by detecting the density or color (Lab) of the image. Still another function is to detect the distance from the sensor unit 17 to an opposite surface. The difference between the height of a platen 2 and the height of the sensor unit 17 and the printhead 7 is known from the design, and hence it is possible to detect the distance between the printhead 7 and the sheet 3. This distance changes depending on the thickness of the sheet 3 or the like.

The printing apparatus 100 includes the platen 2 provided at a position facing the printhead 7. The sheet 3 is conveyed onto the platen 2, and an image is printed on the sheet. The housing 1 accommodates a suction device 4 for chucking the sheet 3 to the platen 2. The suction device 4 is, for example, a fan.

Figure 3:
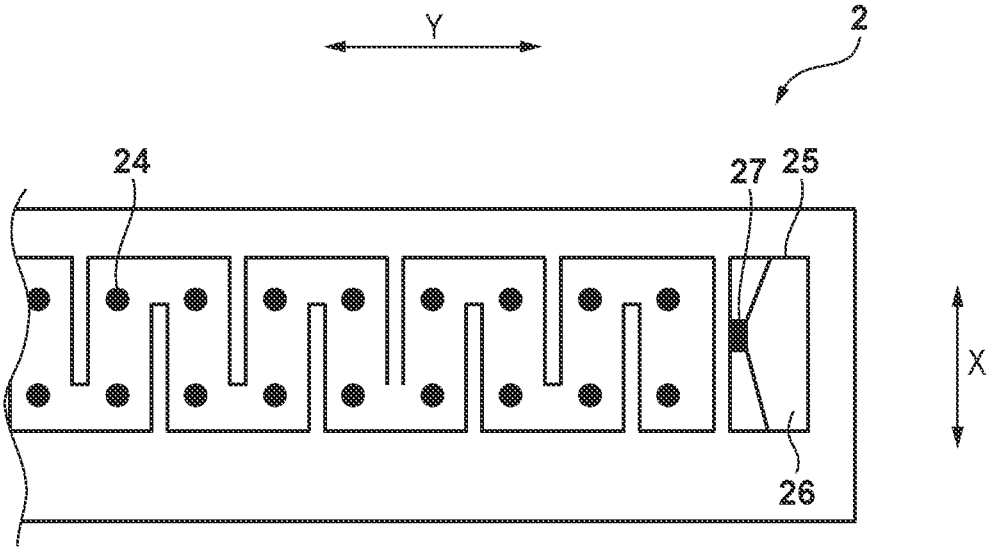
FIG. 3 is a plan view of the platen of the printing apparatus in FIG. 1.

FIG. 3 is a top view of part of the platen 2 when seen from above. The surface of the platen 2 is provided with a plurality of suction portions (suction holes) 24 for chucking the sheet 3 onto the platen 2 and a plurality of grooves 25 (only one of them is shown in FIG. 3) capable of recovering ink discharged by the printhead 7. The plurality of suction portions 24 and the plurality of grooves 25 communicate with the suction device 4 and can suck air upon operation of the suction device 4.

The grooves 25 are grooves for recovering ink discharged to the outside of the sheet 3 when performing marginless printing (to be described later). The grooves 25 are provided at positions corresponding to predetermined sheet sizes. Two grooves are provided so as to be located adjacent to the edges of a sheet of one size in the widthwise direction. If there are two types of sheet sizes which can be handled, a total of four grooves 25 are provided.

Figure 4A:
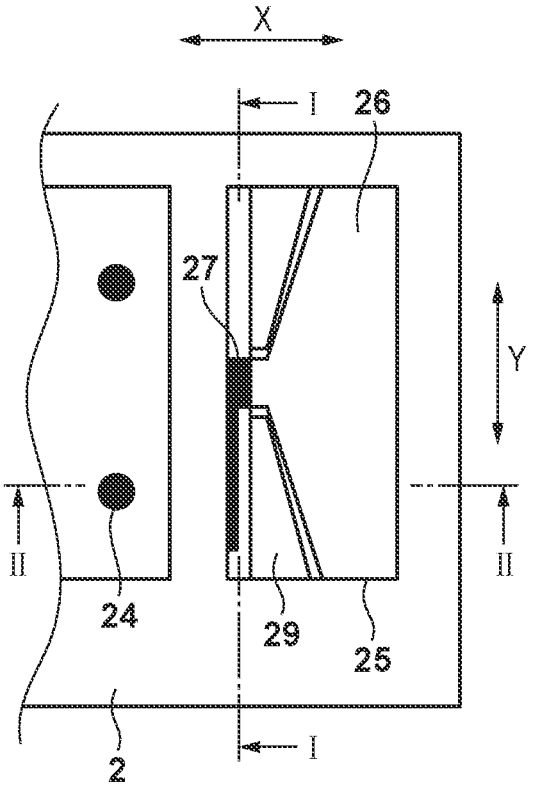
FIG. 4A is a partial enlarged view of the platen in FIG. 3.
Figure 4B:
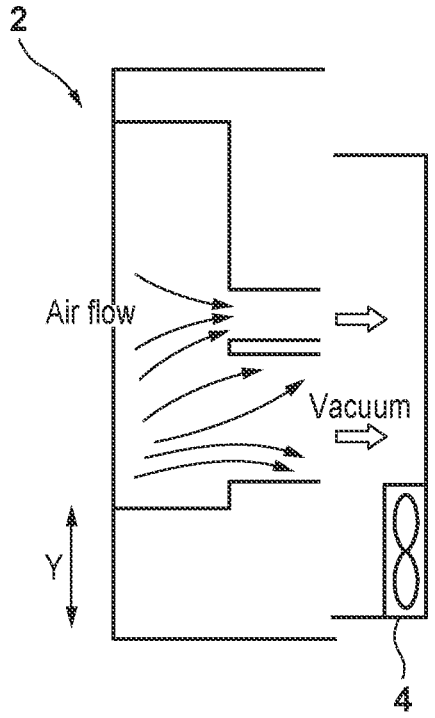
FIG. 4B is a sectional view taken along a line I-I in FIG. 4A.
Figure 4C:
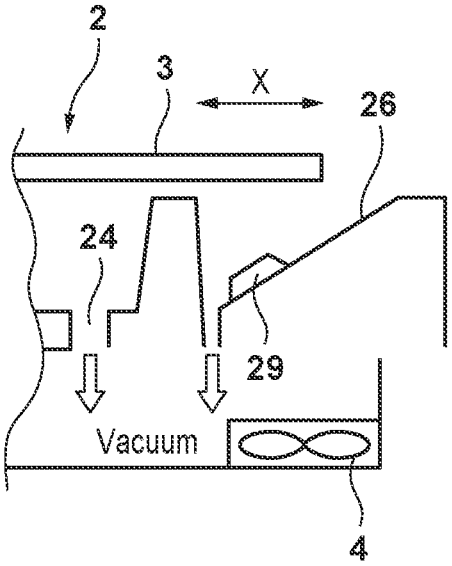
FIG. 4C is a sectional view taken along a line II-II in FIG. 4A.
Figure 5:
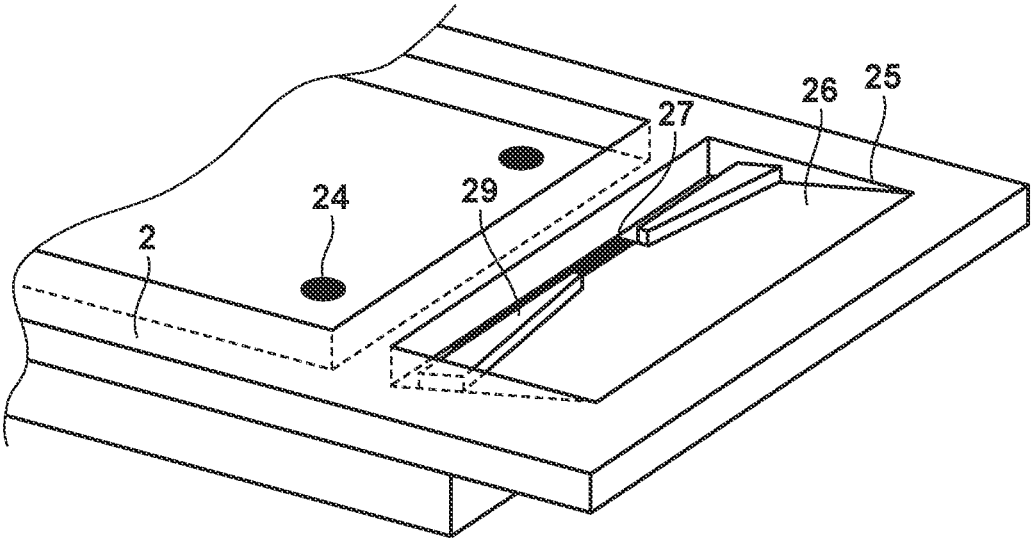
FIG. 5 is a partial perspective view of the platen in FIG. 3.

The structure of the groove 25 will be further described with reference to FIGS. 4A to 4C and 5. FIG. 4A is a partial enlarged view of the platen 2. FIG. 4B is a sectional view taken along a line I-I in FIG. 4A. FIG. 4C is a sectional view taken along a line II-II in FIG. 4A. FIG. 5 is a partial perspective view of the platen 2.

The groove 25 includes a landing surface 26 on which ink discharged by the printhead 7 is landed, a suction hole 27 for exhausting landed droplets, and an inclined rib 29. The landing surface 26 is an inclined surface. The suction hole 27 is located on an extension of the landing surface 26. Therefore, ink landed on the landing surface 26 flows downward because of the inclination of the landing surface and is further guided into the suction hole 27 by the rib 29 to be exhausted. The suction hole 27 has a size large enough to exhaust wasted droplets, and wasted ink is recovered in a wasted ink box (not shown).

Note that a cutting unit (not shown) is provided on the downstream side of the platen 2. The cutting unit cuts the sheet 3 in the main scanning direction X.

<Arrangement of Control Unit>

Figure 6:
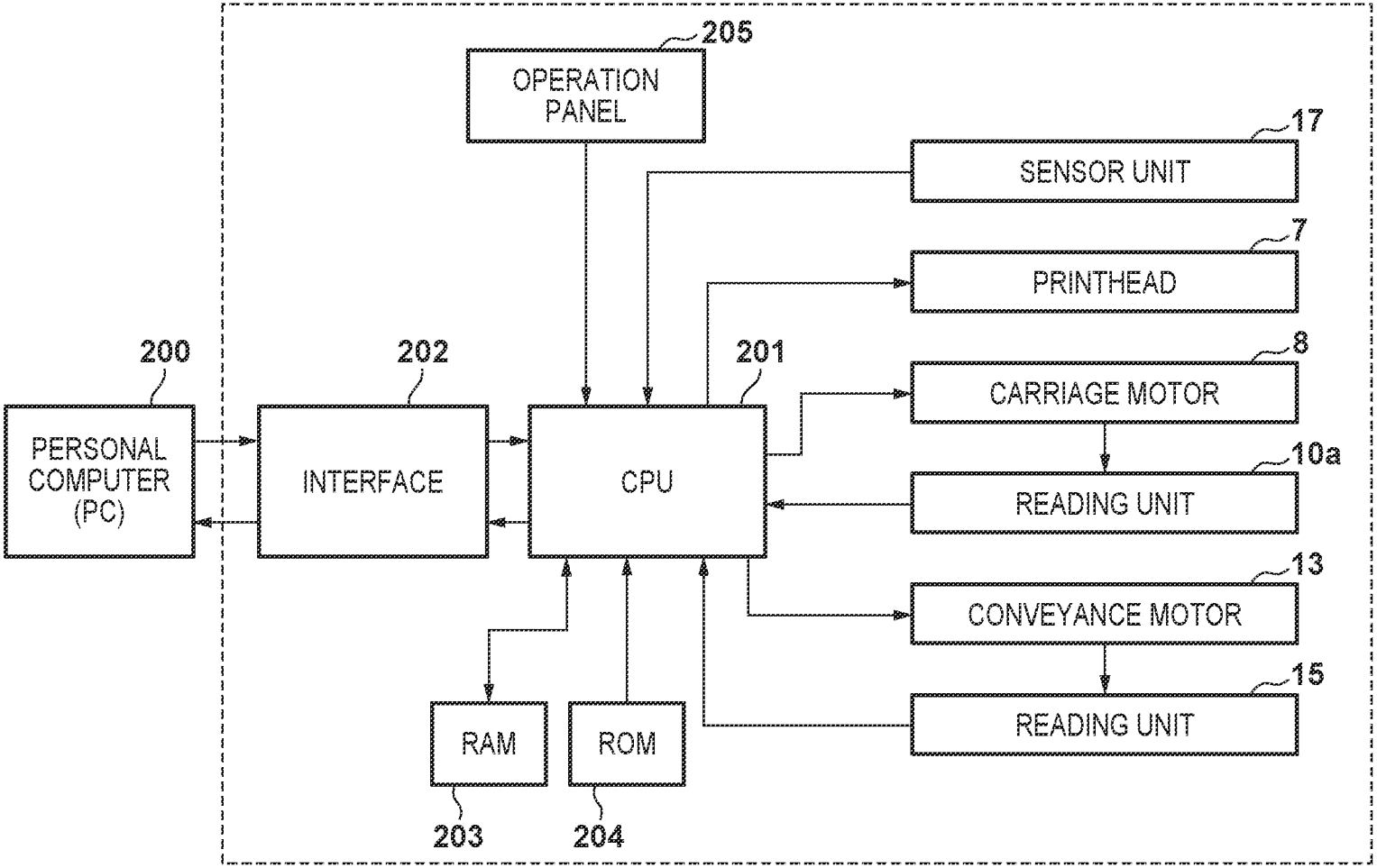
FIG. 6 is a block diagram of the control unit of the printing apparatus in FIG. 1.

The arrangement of the control unit of the printing apparatus 100 will be described with reference to FIG. 6. FIG. 6 is a block diagram of the control unit.

A CPU 201 controls the overall printing apparatus 100 by reading out programs stored in a ROM 204. The CPU 201 controls a printing operation (discharging ink and moving the carriage 6 using the carriage motor 8) performed by the printhead 7 based on a reading result obtained by the reading unit 10*a* or a reading result obtained by the sensor unit 17. In addition, the CPU 201 executes conveyance control of the sheet 3 by controlling the conveyance motor 13 based on the reading result obtained by the reading unit 15.

A RAM 203 stores print data and temporal data. Data such as settings selected by the user can be written in the RAM 203 and read out as needed. The ROM 204 stores programs and the like executed by the CPU 201. The RAM 203 and the ROM 204 may be other types of storage devices. An operation panel 205 is an input device which receives inputs from the user, and is, for example, a touch panel. The CPU 201 exchanges print data and the like with a PC (Personal Computer) 200 via an interface 202.

When the PC 200 transmits print data, the information is transmitted to the CPU 201 via the interface 202. The CPU 201 temporarily saves the print data in the RAM 203, and reads out the print data thereafter, as needed. At the same time, the CPU 201 performs a printing operation in accordance with a control program stored in the ROM 204.

In a printing operation, the sheet 3 is intermittently conveyed in the sub-scanning direction. While the conveyance of the sheet 3 is stopped, ink is discharged from the printhead 7 while the carriage 6 is moved in the main scanning direction X. An image is printed on the sheet 3 by alternately conveying the sheet 3 and printing using the printhead 7. When an image as a single unit is printed, the sheet 3 is cut by the cutting unit.

<Printing Mode>

In this embodiment, printing modes include margin printing and borderless printing. Borderless printing further includes marginless printing and micro-margin printing. These printing modes will be sequentially described below.

<Margin Printing>

Figure 7A:
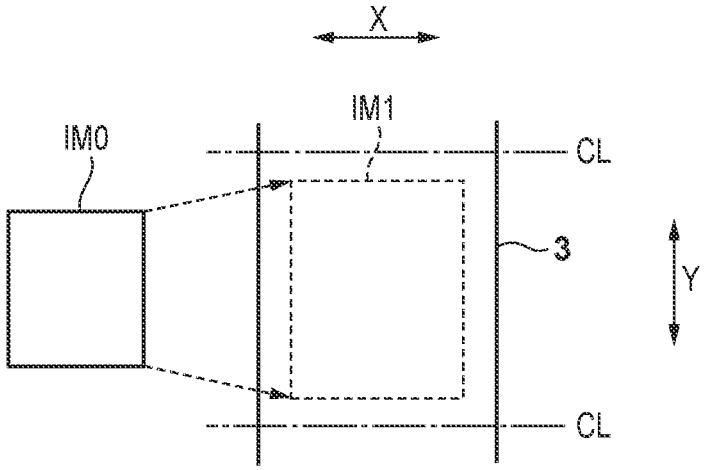
FIGS. 7A to 7C are views each showing an example of how the size of image data is changed.

FIG. 7A is a conceptual view of margin printing. An image IM0 indicates the image size of an original image created on the PC 200. An image IM1 indicates the image size of print data received by the printing apparatus 100. A broken line CL indicates a cut line on the sheet 3.

In margin printing, a margin (for example, 3 mm) is provided on each of the edges of the four sides of the sheet 3. In the PC 200, for example, a printer driver creates print data (image IM1) by enlarging or reducing the image IM0 to the size of the sheet 3 designated by the user, with a margin amount being excluded from each edge, and transmits the created data to the printing apparatus 100. The printing apparatus 100 prints the image IM1 on the sheet 3 based on the received print data. The image size of the print data received by the printing apparatus 100 coincides with the image size of the image printed on the sheet 3 in principle.

Note however that it is possible to make the sensor unit 17 detect the size of the sheet 3 set on the printing apparatus 100 and give higher priority to the sheet size detected by the sensor unit 17 than to the sheet size set in the PC 200. In this case, the image size of the print data is enlarged or reduced to the sheet size detected by the sensor unit 17, and the resultant print data is printed on the sheet 3.

If the sheet size set in the PC 200 differs from the sheet size detected by the sensor unit 17, it is possible to allow the user to make setting on the PC 200 or make selection on the operation panel 205 as to whether to give priority to a detection result obtained by the sensor unit 17.

<Marginless Printing>

Figure 7B:
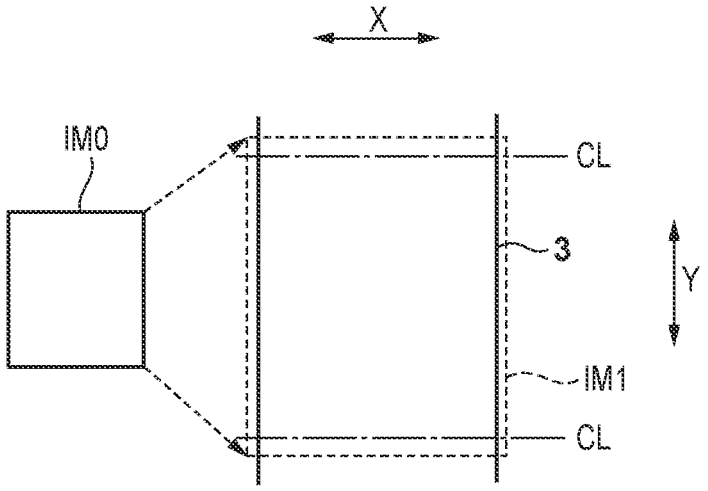

FIG. 7B is a conceptual view of marginless printing. In marginless printing, no margin is provided on the edges of the four sides of the sheet 3. Therefore, an image printing operation (ink discharging) is also performed on the outside of the sheet 3 in the widthwise direction. Note however that ink discharged to the outside of the sheet does not contribute to image formation, and hence is discarded as a result. In the PC 200, for example, the printer driver creates print data (IM1) by enlarging or reducing the image IM0 to a size larger than the size of the sheet 3 designated by the user by an amount by which the printed image exceeds each edge, and transmits the created data to the printing apparatus 100. When the carriage 6 crosses the sheet 3, the printing apparatus 100 starts a printing operation (ink discharging) from the outside of one end of the sheet 3 in the widthwise direction and finishes the printing operation (ink discharging) at the outside of the other end. Ink is also landed on the outside of the sheet 3. The printing apparatus 100 can perform borderless printing with respect to the four sides by cutting the sheet 3 inside the upstream and downstream ends of the printed image (CL).

In marginless printing, the image size of an image printed on the sheet 3 is smaller than that of print data received by the printing apparatus 100 in principle. As described concerning margin printing, it is possible to print an image on the sheet 3 upon enlarging or reducing the image size of the print data in accordance with the sheet size detected by the sensor unit 17.

The printing start position and the printing end position can be adjusted in accordance with the position of an edge of the sheet 3 detected by the sensor unit 17. That is, it is possible to delete print data, of the print data outside an edge of the sheet 3, which is far from the edge, instead of printing the print data received from the PC 200 without any change. Minimizing a printed portion outside the sheet 3 can suppress the amount of ink wasted.

<Micro-Margin Printing>

Micro-margin printing is a new technique of performing borderless printing without printing any image outside the sheet 3.

Figure 7C:
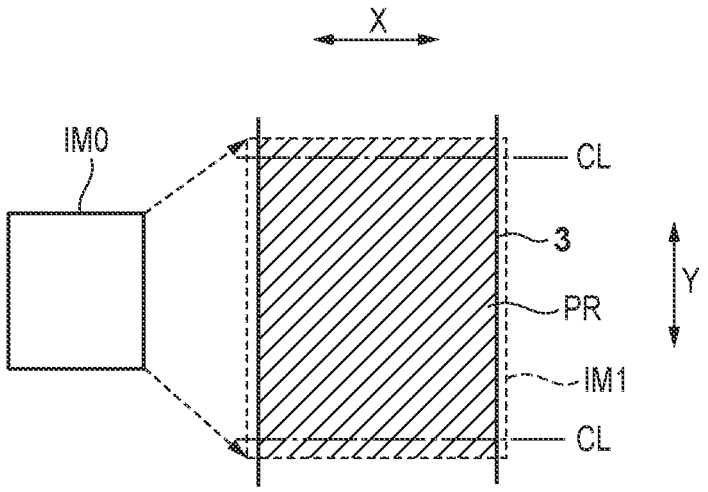

FIG. 7C is a conceptual view of micro-margin printing. In micro-margin printing, printing is performed up to barely the inside of the edges of the sheet 3. For this reason, no ink is discarded to the outside of the sheet. Although margins are formed on the edges of the sheet 3, a substantially borderless image is printed by setting a margin amount so as to make the margins visually unnoticeable or make it difficult to recognize the margins as they are. That is, micro-margin printing formally includes margins, but can be substantially regarded as one type of borderless printing.

The margin amount is controlled to a specified value or less. For example, the margin amount can be controlled to 1.5 mm or less, more preferably to 1.0 mm or less, and still more preferably to 0.5 mm or less.

In the PC 200, for example, the printer driver creates print data (IM1) by enlarging or reducing the image IM0 to a size that makes the image exceed each edge of the sheet 3 of a size designated by the user, and transmits the created data to the printing apparatus 100. When the carriage 6 crosses the sheet 3, the printing apparatus 100 starts printing (discharging ink) from the inside of one end of the sheet 3 in the widthwise direction and finishes printing (discharging ink) at the inside of the other end. This makes it possible to perform borderless printing while suppressing ink from being landed on the outside of the sheet 3, reducing the amount of printing material (ink) wasted, and preventing stain on a peripheral portion. Borderless printing with respect to the four sides can be performed by cutting the sheet 3 along the inside of the upstream and downstream ends of the printed image (CL). Strictly speaking, the printed image has minute margins on the edges of the sheet 3 in the widthwise direction and no margins on the edges of the sheet 3 in the conveying direction.

In micro-margin printing, the image size of an image printed on the sheet 3 is smaller than that of print data received by the printing apparatus 100 in principle. As described in margin printing, it is also possible to print an image on the sheet 3 upon enlarging or reducing the image size of the print data in accordance with a sheet size detected by the sensor unit 17.

Improving the accuracy of control of printing positions (control of ink landing positions) can further reduce margins on the edges of the sheet 3 in the widthwise direction and make the margins minute and unnoticeable. For this reason, it is possible to adjust a printing start position and a printing end position in accordance with the position of an edge of the sheet 3 detected by the sensor unit 17. For example, the sensor unit 17 detects the position of an edge of the sheet 3 in the widthwise direction for every printing scan or a predetermined number of times of printing scan by the movement of the carriage 6. A printing start position and a printing end position are then adjusted in subsequent printing scans by using this detection result. This makes it possible to maintain a margin amount constant and make margins unnoticeable even if the sheet 3 meanders.

An error sometimes occurs between a controlled printing position and an actual printing position. Calibrating this error can more accurately reduce a margin amount of the sheet 3. For this purpose, the sensor unit 17 reads an image printed on the sheet 3, and an error between the controlled printing position and the actual printing position is actually measured, thereby controlling the printing position based on the measurement result.

An example of the arrangement of the sensor unit 17 will be described with reference to FIGS. 8A to 9C.

Figure 8A:
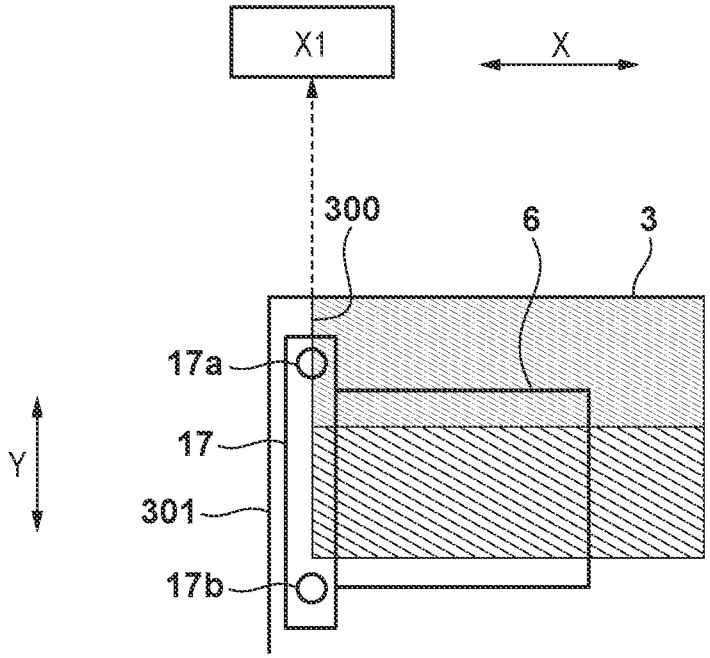
FIGS. 8A and 8B are views for explaining a sensor unit.
Figure 8B:
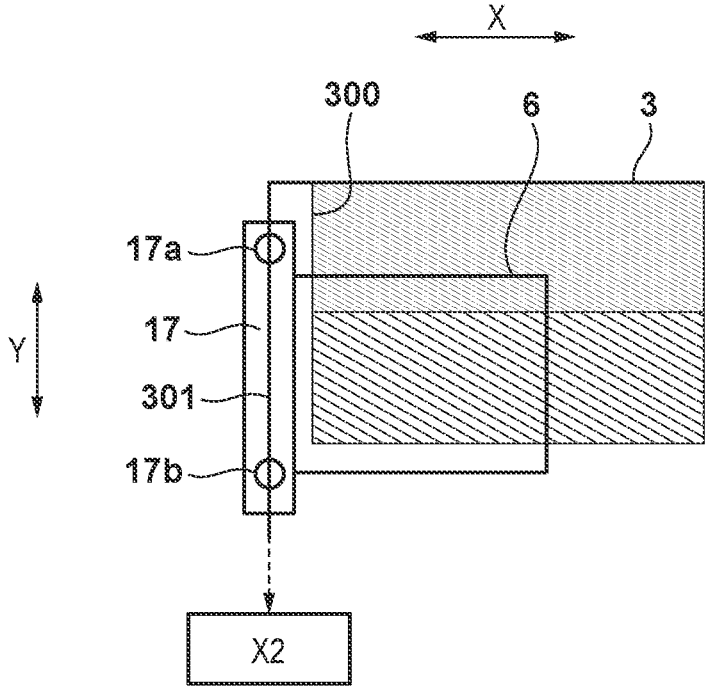

FIGS. 8A and 8B are views for explaining the sensor unit 17. The sensor unit 17 includes a sensor 17*a* for image detection and a sensor 17*b* for detecting an edge of the sheet 3. In this embodiment, these two types of sensors are incorporated into a unit but may be separately provided. Alternatively, image detection and detection of an edge of the sheet 3 may be performed by one type of sensor.

The sensor 17*a* is a sensor for measuring a color density, and is a reflection type optical sensor in this embodiment. The sensor 17*a* can be arranged at a position on the upstream side of the printhead 7. The sensor 17*a* is arranged such that its detecting unit faces the sheet 3 to detect a color density on the opposite surface. As shown in FIG. 8A, when the sensor 17*a* reaches the boundary (image edge 300) between a printed portion of the image and a non-printed portion, a change in color density becomes large at the boundary. As a consequence, the detection result greatly changes. This makes it possible to detect the position of an edge of the image. The result of detecting the position of the carriage 6 (the detection result obtained by the reading unit 10*a*) upon detection of an edge of the image by the sensor 17*a* is stored as position information X1 in the RAM 203.

In this embodiment, the sensor 17*b* is a reflection type optical sensor. The sensor 17*b* can be arranged at a position on the downstream side of the printhead 7. The sensor 17*b* is arranged such that its detecting unit faces the sheet 3, and detects reflected light from the opposite surface. As shown in FIG. 8B, when the sensor 17*b* reaches the boundary (an edge 301 of the sheet 3) between a portion where the sheet 3 exists and a portion where the sheet 3 does not exist, a change in light reception intensity becomes large at the boundary. This makes it possible to detect the position of an edge of the sheet 3. A result of detecting the position of the carriage 6 (a detection result obtained by the reading unit 10*a*) when the sensor 17*b* detects an edge of the sheet 3 is stored as position information X2 in the RAM 203.

When the sensors 17*a* and 17*b* are arranged at the same position in the main scanning direction X, the difference between the position information X1 and the position information X2 coincides with a margin amount. When the sensors 17*a* and 17*b* are arranged at different positions in the main scanning direction X, the difference between the arrangement positions may be added or subtracted. In this manner, the margin amount of an actually printed image can be detected. Controlling a printing position based on the detected margin amount can print an image with a minute margin barely exceeding the edges of the sheet 3. Depending on a manufactured lot or moisture adsorption in an operating environment, sheets to be used can undergo small size variations with respect to the original size. Even with such size variations, it is possible to obtain a printing result with more accurate minute margins by using the above technique.

Figure 10:
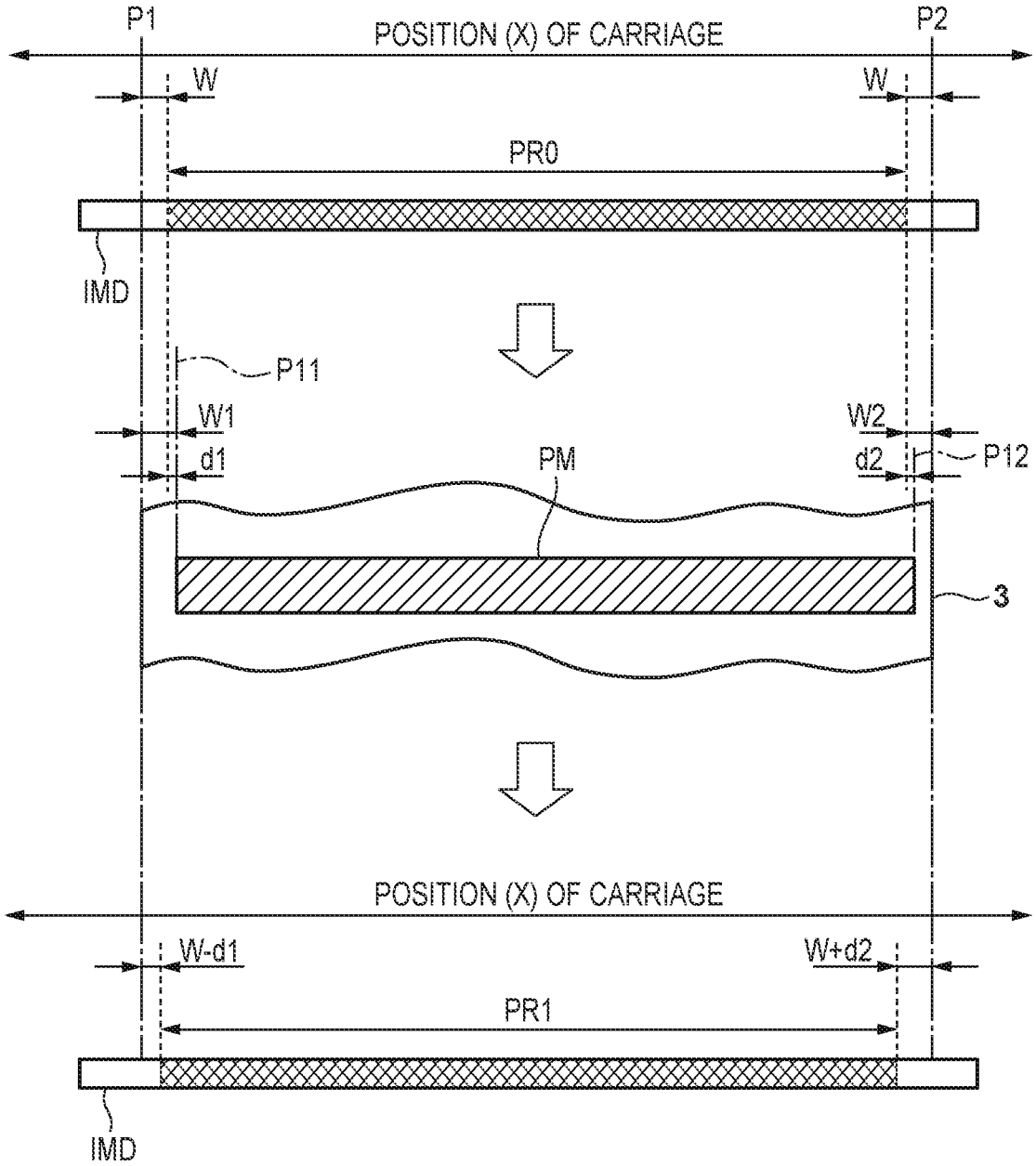
FIG. 10 is a view showing an example of the calibration of a printing position.

FIG. 10 is a view for explaining an example of a printing position calibration. In the example shown in FIG. 10, it is assumed that an image PM is actually printed, with PR0 representing a controlled range of print data, of print data IMD, which is used for printing so as to achieve a target margin amount W.

The range PR0 is associated with the position of the carriage 6. The sensor unit 17 detects positions P1 and P2 of the edges of the sheet 3 in the widthwise direction. The range PR0 is set as a region obtained by removing the margin amounts W at the two ends from the region between the positions P1 and P2 of the edges. A printing start position and a printing end position are set for the image PM as a printed image in the range PR0.

After the image PM is printed, the sensor unit 17 detects positions P11 and P12 of the edges of the image PM. Note that the positions P1 and P2 of the edges of the sheet 3 in the widthwise direction may be detected again or the detection results obtained at the time of setting the range PR0 may be used.

One actual margin amount W1 of the sheet 3 in the widthwise direction is computed as the distance between the positions P1 and P11. The other actual margin amount W2 is computed as the distance between the positions P2 and P12. In the example shown in FIG. 10, assume that target margin amount W<actual margin amount W1 (an error is represented by d1), and target margin amount W>actual margin amount W2 (an error is represented by d2).

In order to calibrate a printing position, the printing start position is set to a position shifted inward from the position P1 of an edge of the sheet by margin amount W−error d1. In addition, the printing end position is set to a position shifted inward from the position P2 of an edge of the sheet by margin amount W+error d2. This makes it possible to bring the actual margin amount to the target margin amount.

A range PR1 of print data after calibration is sometimes set by enlarging or reducing the range PR0 in terms of the length of the sheet 3 in the widthwise direction. In contrast to this, the length of the range PR1 may remain the same without enlargement or reduction. In this case, the printing start position and the printing end position are only shifted. When setting the same length, therefore, it is possible to calibrate only the printing start position by detecting only one of the actual margin amounts W1 and W2 of the sheet 3 instead of detecting both the margin amounts. If the length remains the same, deciding a printing start position will decide a printing end position.

The image PM is only required to allow the detection of the errors between the target margin amount W and the actual margin amounts W1 and W2. The setting of the target margin amount W in the print data PR0 of the image PM may differ from the setting of the target margin amount W when actually printing by micro-margin printing. For example, this setting may be a large value. Setting the target margin amount W to a large value can prevent the image PM from being formed outside of the sheet 3 (prevent ink from being applied to the outside of the sheet).

Referring to FIG. 10, print data of the two end portions of the print data IMD are trimmed. However, this is not exhaustive. For example, only the print data of the end portion on the printing end side may be trimmed.

This embodiment has exemplified the margin amounts on the edges of the sheet 3 in the widthwise direction. However, when printing an image on a cut sheet, it is possible to control printing positions in similar consideration of margin amounts on the edges of the leading and trailing edges of a sheet.

The image PM from which the edge positions P11 and P12 are to be read may be a test pattern or a preceding printed portion when performing actual printing. In other words, printing position calibration may be performed by test printing, and the calibration result may be used for printing position control when actually printing an image. Alternatively, printing position calibration may be performed during actual printing, and the calibration result may be used for printing position control on a succeeding printed portion. A test pattern may be a high-density solid image provided for each type of ink.

When using a test pattern, for example, printing position calibration timings include a timing when the user issues an instruction. The user may be allowed to issue an instruction by operating the PC 200 or the operation panel 205. Alternatively, such an instructing operation may be automatically performed for each image printing amount unit. For example, this operation may be performed every time an image corresponding to one sheet is printed or images corresponding to a plurality of sheets are printed. Alternatively, the operation may be automatically performed at the activation time of the apparatus or when the operating time of the apparatus has reached a predetermined time.

Calibration timings using preceding printed portions include, for example, a timing when the user issues an instruction. The user may be allowed to instruct such a timing by operating the PC 200 or the operation panel 205. This instructing operation may be automatically performed every time one printing scan is performed or a predetermined number of printing scans are performed. In addition, such an operation may be automatically performed for each image printing amount unit. For example, this operation may be performed every time an image corresponding to one sheet is printed or images corresponding to a plurality of sheets are printed. Alternatively, the operation may be automatically performed when printing is performed for the first time after the activation of the apparatus or when the operating time of the apparatus has reached a predetermined time.

In addition, a printing position calibration timing may be set to the timing when a printing condition is changed.

For example, printing conditions include the distance between the printhead 7 and the sheet 3. In a printing scan, the printhead 7 moves while discharging ink. As the distance between the printhead 7 and the sheet 3 increases, the flying time of ink increases. This sometimes shifts a landing position. For example, the distance changes when the type of sheet 3 is changed. As the thickness of the sheet 3 to be used is changed, the distance between the printhead 7 and the sheet 3 changes. For this reason, when changing the type of sheet to be used, it is possible to more accurately control a printing position by performing printing position calibration.

Figure 15A:
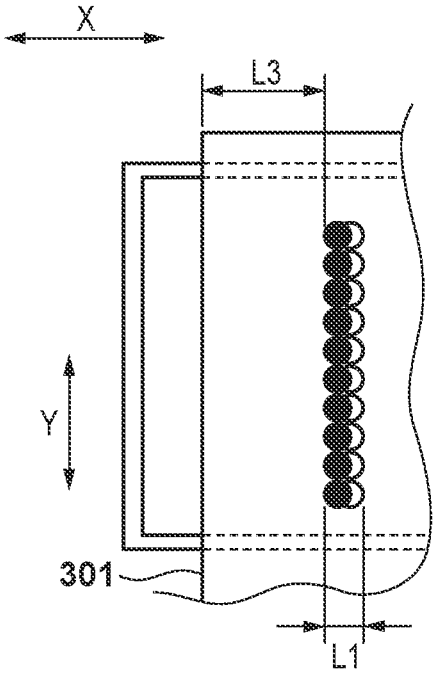
FIGS. 15A to 15D are views for explaining factors that influence the landing position of ink.
Figure 15B:
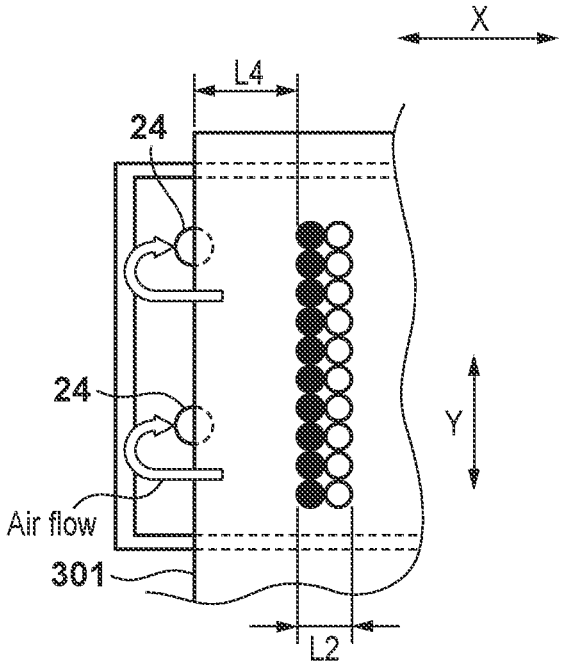

Printing conditions also include, for example, the positions of the suction portions 24 and an edge of the sheet 3 and the suction pressure of each suction portion 24. FIGS. 15A and 15B are views for explaining the influences of the suction portions 24 on landing positions.

One of the factors that cause landing shifts is "end portion flow" caused by suction of the platen 2. FIG. 15A shows a state in which there are no suction portions 24 near an edge of the sheet 3. FIG. 15B shows a state in which there are the suction portions 24 near the edge of the sheet 3. One of these two states can occur depending on the size of the sheet 3.

Referring to FIGS. 15A and 15B, each white circle indicates the discharging position of ink, and each black circle indicates the landing position of ink. Referring to FIG. 15A, a width L1 indicates the shift between the discharging position of ink and the landing position of ink. A width L3 indicates the margin amount between an edge 301 of the sheet 3 and the image. Referring to FIG. 15B, a width L2 indicates the shift between the discharging position of ink and the landing position of ink. A width L4 indicates the margin amount between the edge 301 of the sheet 3 and the image.

As shown in FIG. 15B, when the suction portions 24 are located near the edge 301 of the sheet 3, air flows (AirFlow) are generated toward the suction portions 24. Therefore, the landing positions are greatly shifted toward the suction portions 24 relative to the discharging positions. In contrast to this, in the case shown in FIG. 15A, no air flows (AirFlow) are generated by suction. A width L2 indicates the shift between the discharging position of ink and the landing position of ink. This width is larger than a width L1. A width L4 indicates the margin amount between the edge 301 of the sheet 3 and the image. This width is smaller than a width L3. This indicates that when changing a sheet size, it is possible to more accurately control a printing position by performing printing position calibration.

The suction pressure of each suction portion 24 can be changed to more accurately convey the sheet 3 depending on a sheet type, a sheet conveying direction, a sheet width, and the like. As the suction pressure increases, an air flow (AirFlow) increases to greatly shift the landing position. This indicates that when changing the suction pressure, it is possible to more accurately control a printing position by performing printing position calibration.

Figure 15C:
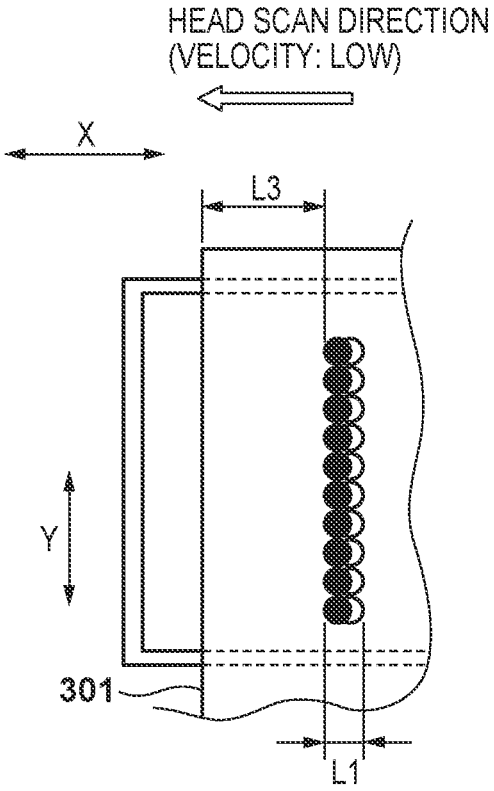
Figure 15D:
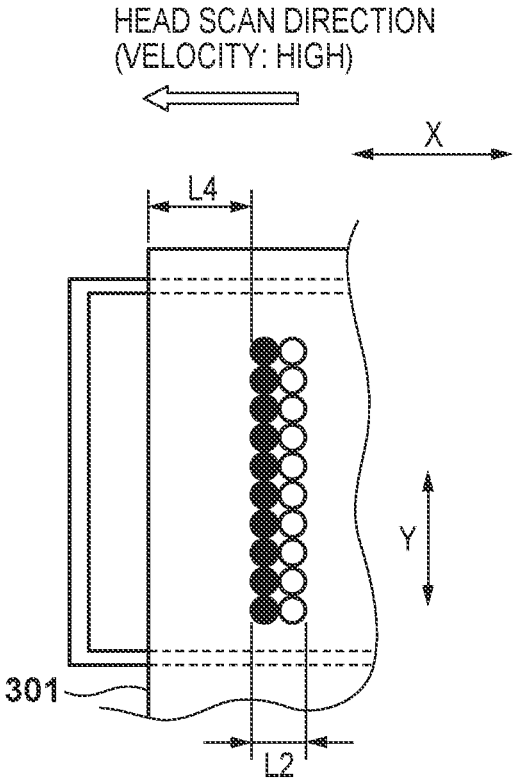

In addition, printing conditions include, for example, the moving velocity of the carriage 6 (the moving velocity of the printhead 7) in a constant speed region. FIGS. 15C and 15D are views for explaining the influence of the moving velocity of the carriage 6 on each landing position. FIG. 15C shows a case in which the carriage velocity is low in the constant speed region. FIG. 15D shows a case in which the carriage velocity is high in the constant speed region.

Referring to FIGS. 15C and 15D, each white circle indicates the discharging position of ink, and each black circle indicates the landing position of ink. Referring to FIG. 15C, a width L1 indicates the shift between the discharging position of ink and the landing position of ink. A width L3 indicates the margin amount between an edge 301 of the sheet 3 and the image. Referring to FIG. 15D, a width L2 indicates the shift between the discharging position of ink and the landing position of ink. A width L4 indicates the margin amount between the edge 301 of the sheet 3 and the image.

The inertial velocity of each flying ink droplet changes in proportion to a carriage velocity, resulting in a difference in landing position. The width L2 indicates the shift between the discharging position of ink and the landing position of ink. This width is larger than the width L1. The width L4 indicates the margin amount between the edge 301 of the sheet 3 and the image. This width is smaller than the width L3. This indicates that when changing the moving velocity of the printhead 7, it is possible to more accurately control a printing position by performing printing position calibration.

Printing position calibration timings also include a timing when a component of the printing apparatus 100 is attached/detached or replaced. If, for example, the printhead 7 is designed to be detachable from the carriage 6, this is a timing when the printhead 7 is detached from the carriage 6 or replaced. A landing position sometimes shifts because of the individual difference of each component or a position shift at the time of detachment of a component. It is possible to more accurately control a printing position by performing printing position calibration.

<Example of Processing>

Figure 11:
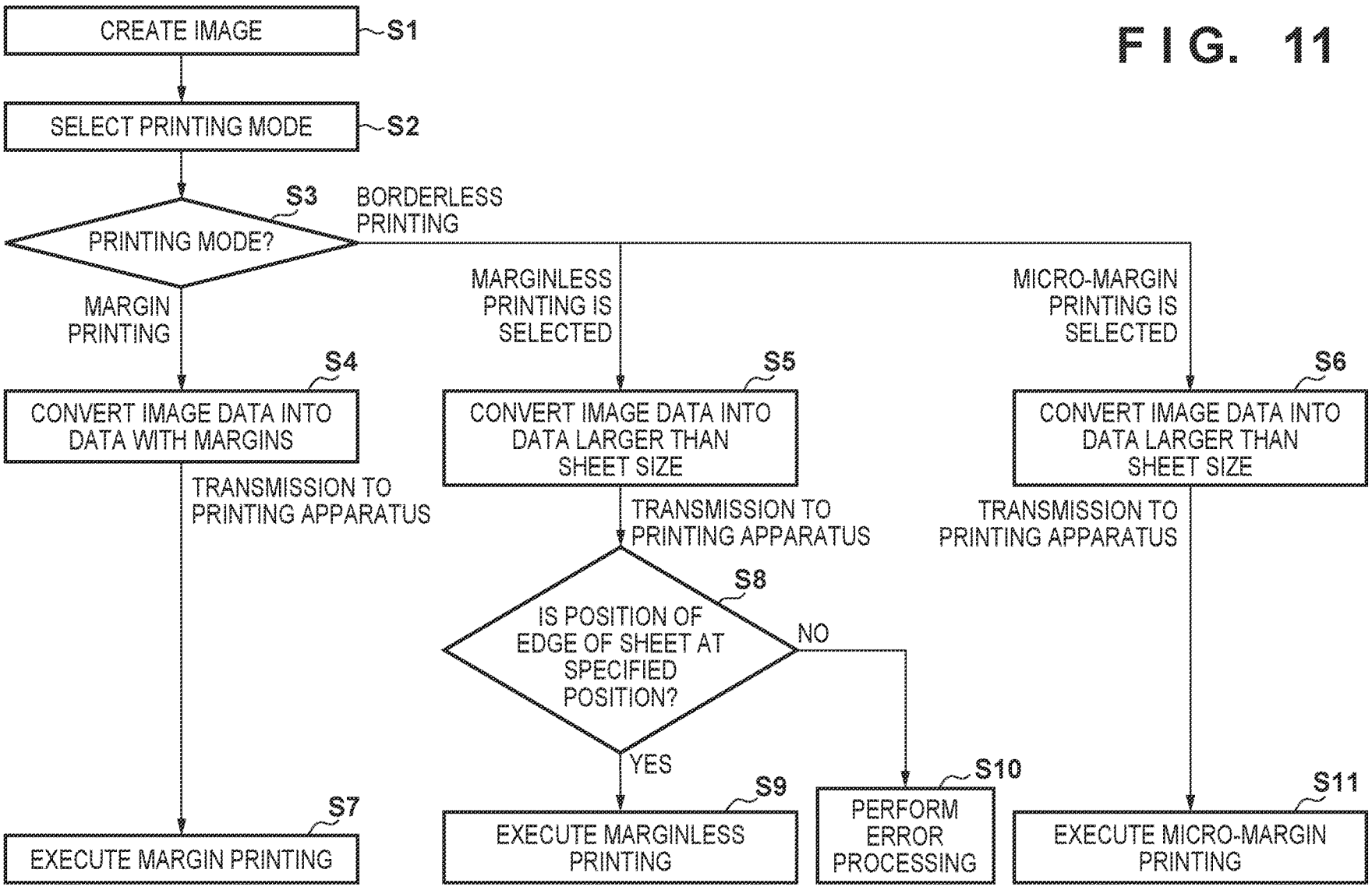
FIG. 11 is a flowchart showing a processing example.

An example of processing by the PC 200 and the printing apparatus 100 will be described next. FIG. 11 is a flowchart for this processing. The following is a case in which the user selects a printing mode. Processing in steps S1 to S6 in FIG. 11 is that performed on the PC 200 side. Processing in steps S2 to S6 is that executed by the printer driver. Processing in steps S7 to S11 is that executed by the printing apparatus 100.

In step S1, the user creates an image by using an arbitrary application on the PC 200. When printing an image, the user selects a printing mode on the PC 200 in step S2.

In step S3, the printer driver determines the printing mode selected by the user. If the user has selected margin printing, the process advances to step S4. In this step, the printer driver generates print data by enlarging or reducing image data so as to provide a set margin amount with respect to the set size of a sheet, and transmits the generated data to the printing apparatus 100.

If the user has selected marginless printing of borderless printing, the process advances to step S5. In this step, the printer driver generates print data by enlarging or reducing image data so as to make the image size larger than the set size of a sheet, and transmits the generated data to the printing apparatus 100.

If the user has selected micro-margin printing, the process advances to step S6. In this step, the printer driver generates print data by enlarging or reducing image data so as to make the image size larger than the set size of a sheet, and transmits the generated data to the printing apparatus 100.

In step S7, the printing apparatus 100 executes margin printing. An image with margins is printed on the sheet 3. In step S11, the printing apparatus 100 executes micro-margin printing. Borderless printing with minute margins is performed so that a printed image is not formed outside of the sheet 3 in the widthwise direction (so as not to discard ink outside of the sheet 3).

When the user has selected marginless printing, although marginless printing may be performed without any change, the printing apparatus 100 determines in step S8 in this embodiment whether each edge of the sheet 3 in the widthwise direction is located at a specified position. More specifically, the printing apparatus 100 determines whether each edge of the sheet 3 in the widthwise direction is located on the groove 25.

If each edge of the sheet 3 in the widthwise direction is located on the groove 25, the process advances to step S9 to execute marginless printing. With this operation, ink discharged to the outside of the sheet 3 is recovered in the groove 25 to prevent the platen 2 from being stained.

If each edge of the sheet 3 in the widthwise direction is not located on the groove 25, the process advances to step S10 to execute error processing. This makes it possible to prevent ink discharged to the outside of the sheet 3 from being recovered in the groove 25 and staining the platen 2.

In this case, the position of each groove 25 is known in design. If, therefore, a sheet size is known, it is possible to determine whether each edge of the sheet is located on the groove 25. The printing apparatus 100 can perform the determination in step S8 based on the sheet size.

The printing apparatus 100 may perform the determination in step S8 in another manner. That is, the printing apparatus 100 may store design position information of each groove 25 in the ROM 204 in advance and perform determination by comparing the stored information with a detection result on the position of each edge of the sheet 3 obtained by the sensor 17*b* of the sensor unit 17.

The printing apparatus 100 may perform the determination in step S8 in still another manner. That is, the printing apparatus 100 may determine, based on actual measurement, whether each edge of the sheet 3 is located on the groove 25. There is sometimes an error between the design position of each groove 25 and the position of an actual product. If the printing apparatus 100 is a large-size printing apparatus in particular, this error is sometimes large. It is therefore possible to perform high-accuracy determination based on actual measurement.

Figure 9A:
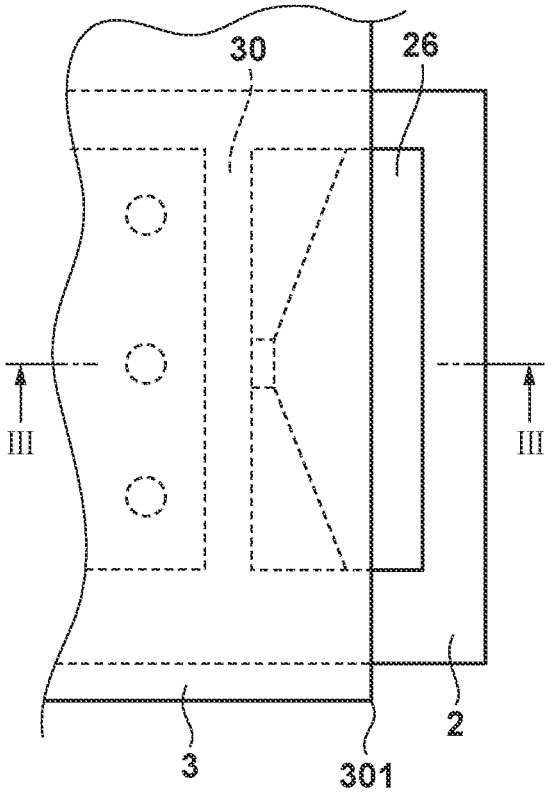
FIGS. 9A to 9C are views for explaining the principle of detecting the position of an edge of a sheet.
Figure 9B:
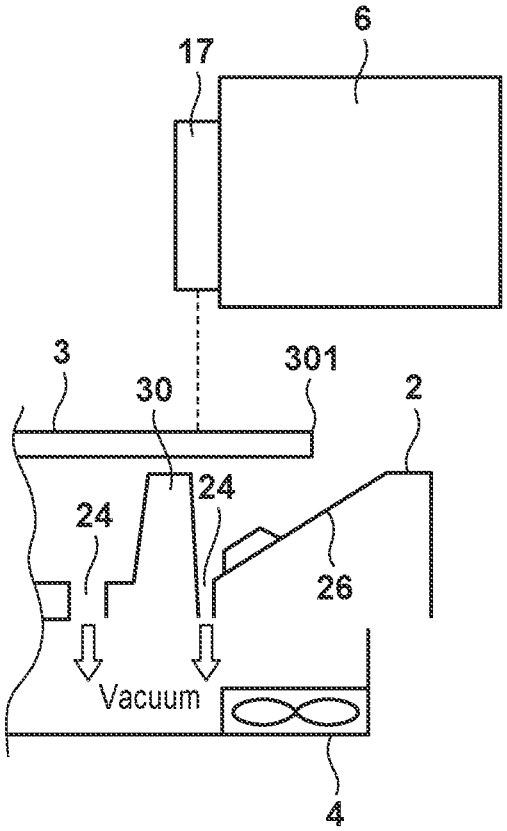
Figure 9C:
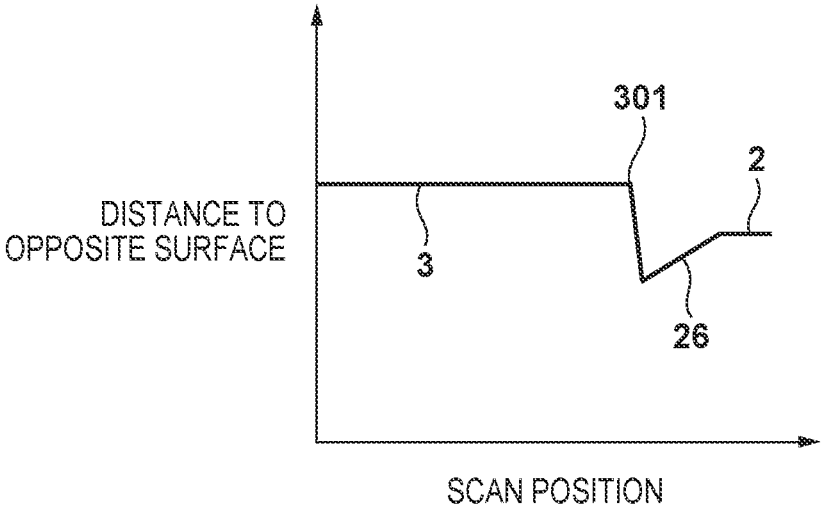

The sensor 17*b* of the sensor unit 17 can perform actual measurement for determination of whether each edge of the sheet 3 is located on the groove 25. FIGS. 9A to 9C are views for explaining this operation. FIG. 9A is a plan view showing a state in which an edge of the sheet 3 is located on the groove 25 (on the landing surface 26). FIG. 9B is a sectional view taken along a line III-III in FIG. 9A and showing an example of the position of the sensor unit 17. The sensor 17*b* can detect the distance to an opposite surface based on the intensity of received light. When the sensor unit 17 moves along a line III-III in FIG. 9A, a distance detection result obtained by the sensor 17*b* appears as shown in FIG. 9C. Reference numerals on the line indicate the detected positions of the sheet 3, the edge 301, the platen 2, and the landing surface 26.

The height of the conveyance surface of the platen 2 is known. The surface of the sheet 3 is higher than the conveyance surface by the thickness of the sheet 3. The landing surface 26 is lower than the conveyance surface. It is therefore possible to read the positions of the landing surface 26 and the edge 301 of the sheet 3 from a distance detection result obtained by the sensor 17*b*. This makes it possible to determine whether each edge of the sheet 3 is located on the groove 25.

Figure 12:
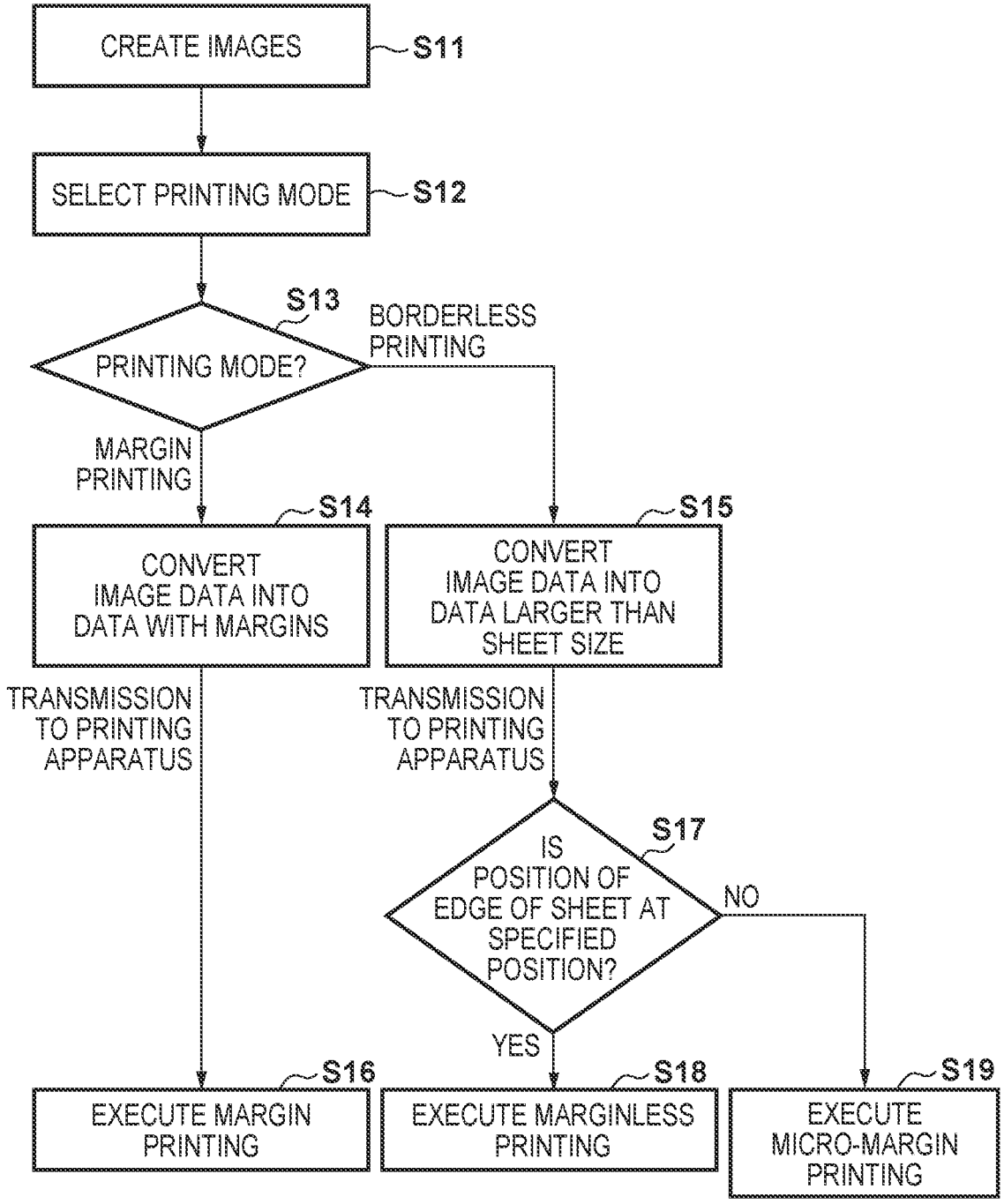
FIG. 12 is a flowchart showing a processing example.

FIG. 12 shows another processing example. In the example shown in FIG. 12, the user selects margin printing or borderless printing, and the printing apparatus 100 automatically selects marginless printing or micro-margin printing. Processing in steps S11 to S15 in FIG. 12 is that performed on the PC 200 side. Processing in steps S12 to S15 is that executed by the printer driver. Processing in steps S16 to S19 is that executed by the printing apparatus 100.

In step S11, the user creates an image by using an arbitrary application on the PC 200. When printing an image, the user selects a printing mode on the PC 200 in step S12.

In step S13, the printer driver determines the printing mode selected by the user. If the user has selected margin printing, the process advances to step S14. In this step, the printer driver generates print data by enlarging or reducing image data so as to provide a set margin amount with respect to the set size of a sheet, and transmits the generated data to the printing apparatus 100.

If the user has selected borderless printing, the process advances to step S15. In this step, the printer driver generates print data by enlarging or reducing image data so as to make the image size larger than the set size of a sheet, and transmits the generated data to the printing apparatus 100.

In step S17, the printing apparatus 100 determines whether an edge of the sheet 3 in the widthwise direction is located at a specified position. More specifically, the printing apparatus 100 determines whether an edge of the sheet 3 in the widthwise direction is located on the groove 25. This determination processing is the same as that performed in step S8 in the example shown in FIG. 11.

If the edge of the sheet 3 in the widthwise direction is located on the groove 25, the process advances to step S18 to execute marginless printing. This makes it possible to perform borderless printing without staining the platen 2 by recovering ink discharged to the outside of the sheet 3 in the groove 25.

If an edge of the sheet 3 is not located on the groove 25, the process advances to step S19 to execute micro-margin printing. The printing apparatus 100 performs borderless printing with minute margins so that a printed image is not formed outside of the sheet 3 in the widthwise direction (so as not to discard ink outside of the sheet 3).

In this manner, when the user has selected borderless printing, it is possible to automatically select and execute either marginless printing or micro-margin printing depending on whether each edge of the sheet 3 is located on the groove 25. This can perform borderless printing on the sheet 3 of each size while preventing the surroundings of the platen 2 from being stained with ink.

Figure 13:
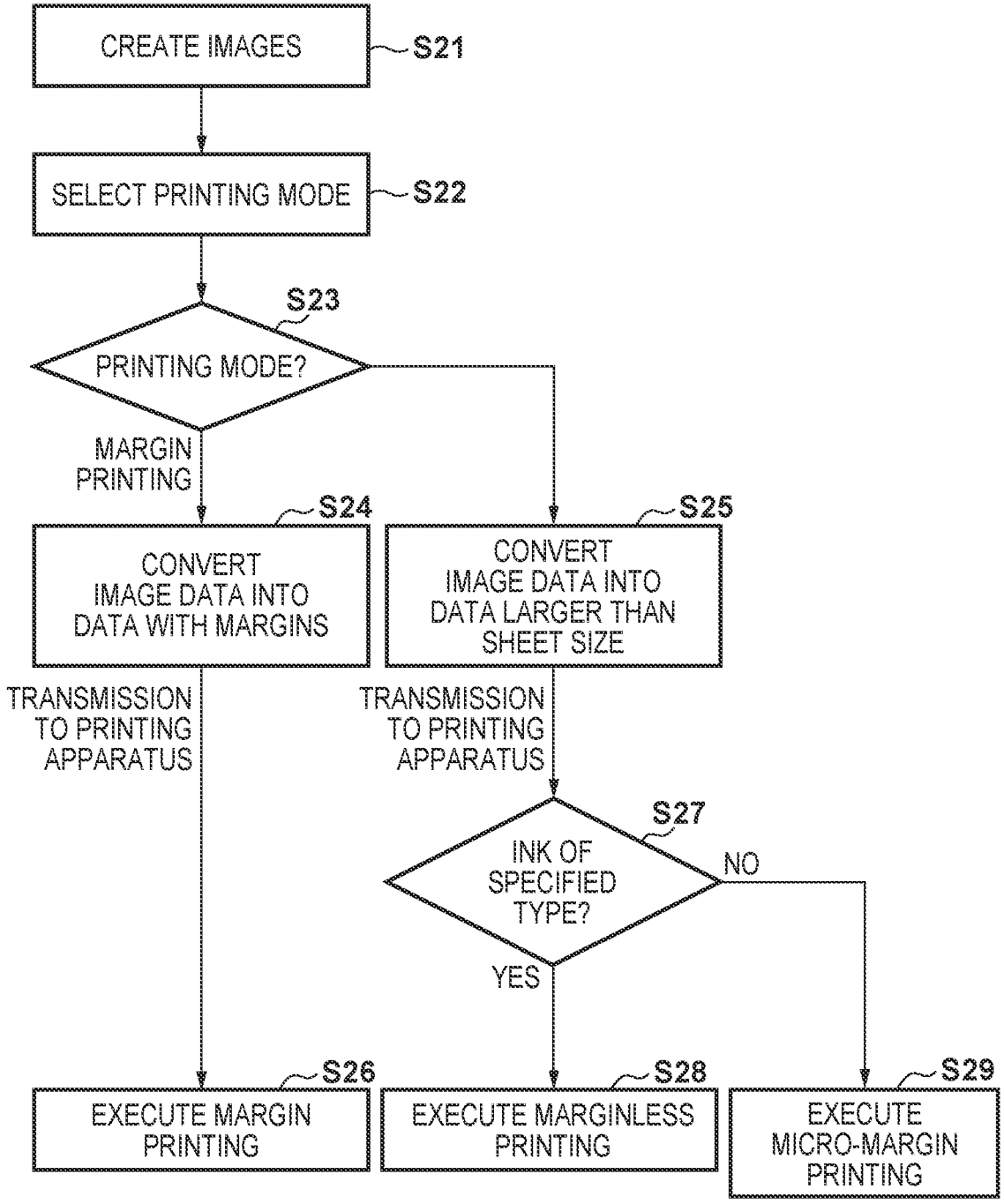
FIG. 13 is a flowchart showing a processing example.

FIG. 13 shows still another processing example. In the example shown in FIG. 13 as well, the user selects margin printing or borderless printing, and the printing apparatus 100 automatically selects marginless printing or micro-margin printing. In this case, the printing apparatus 100 selects marginless printing or micro-margin printing depending on the type of ink.

Figure 14:
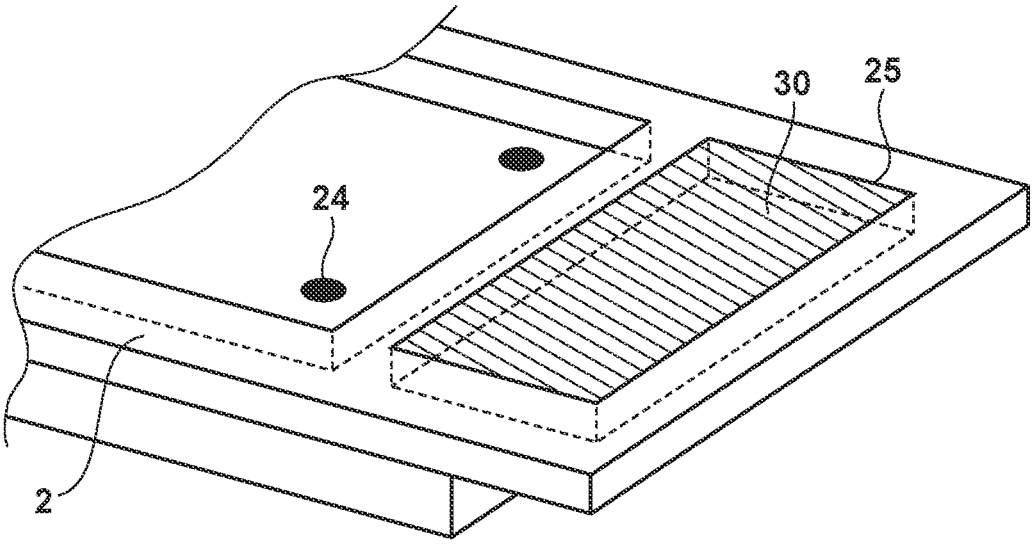
FIG. 14 is a perspective view showing an example of the arrangement of a platen.

In general, an inkjet printing apparatus uses four to 12 types of inks. Different types of inks have different viscosities. As an ink viscosity increases, ink is deposited on the groove 25, and the ink is not sometimes smoothly recovered. The same applies to even a case in which an absorber 30 which absorbs ink is embedded in each groove 25, as shown in, for example, FIG. 14.

It is therefore possible to effectively prevent the deposition of ink by performing micro-margin printing when using ink of a type that tends to be deposited or otherwise performing marginless printing.

Processing in steps S21 to S25 in FIG. 13 is that performed on the PC 200 side. Processing in steps S22 to S25 is that executed by the printer driver. Processing in steps S26 to S29 is that executed by the printing apparatus 100.

In step S21, the user creates an image by using an arbitrary application on the PC 200. When printing an image, the user selects a printing mode on the PC 200 in step S22.

In step S23, the printer driver determines the printing mode selected by the user. If the user has selected margin printing, the process advances to step S24. In this step, the printer driver generates print data by enlarging or reducing image data so as to provide a set margin amount with respect to the set size of a sheet, and transmits the generated data to the printing apparatus 100.

If the user has selected borderless printing, the process advances to step S25. In this step, the printer driver generates print data by enlarging or reducing image data so as to make the image size larger than the set size of a sheet, and transmits the generated data to the printing apparatus 100.

In step S27, the printing apparatus 100 determines the type of ink. If the ink is of a specified type (of a type that does not tend to be deposited), the printing apparatus 100 executes marginless printing in step S28. If the ink is of a type (a type that tends to be deposited) other than the specified type, the printing apparatus 100 executes micro-margin printing in step S29.

The example of processing in steps S27 to S29 will be described in further detail. In this example, the printing apparatus 100 selects either marginless printing or micro-margin printing on a nozzle basis instead of a printhead basis. A nozzle group of the printhead 7 which is designed to discharge the specified type of ink is used to execute marginless printing. A nozzle group designed to discharge ink of a type other than the specified type is used to execute micro-margin printing. Therefore, during one printing scan, there exist nozzles (for marginless printing) which also discharge ink to the outside of the sheet 3 and nozzles (for micro-margin printing) which discharge no ink to the outside of the sheet 3. Although ink of a type other than the specified type is not discharged near edges of the sheet 3 in the widthwise direction in micro-margin printing, and the width of the corresponding portion is minute, it is possible to perform borderless printing without making changes in color tone greatly noticeable.

It is possible to perform borderless printing while preventing the deposition of ink on the platen 2 by selectively switching print control depending on the type of ink in this manner.

Second Embodiment

Figure 16B:
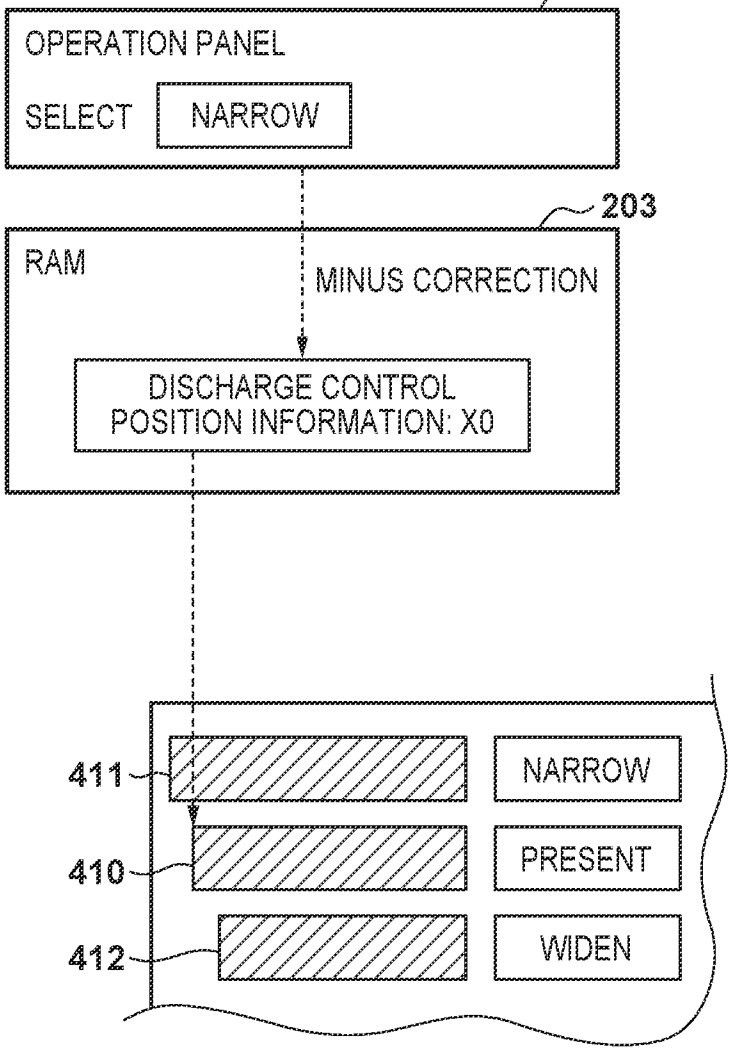
FIGS. 16A and 16B are views for explaining another example.
Figure 16A:
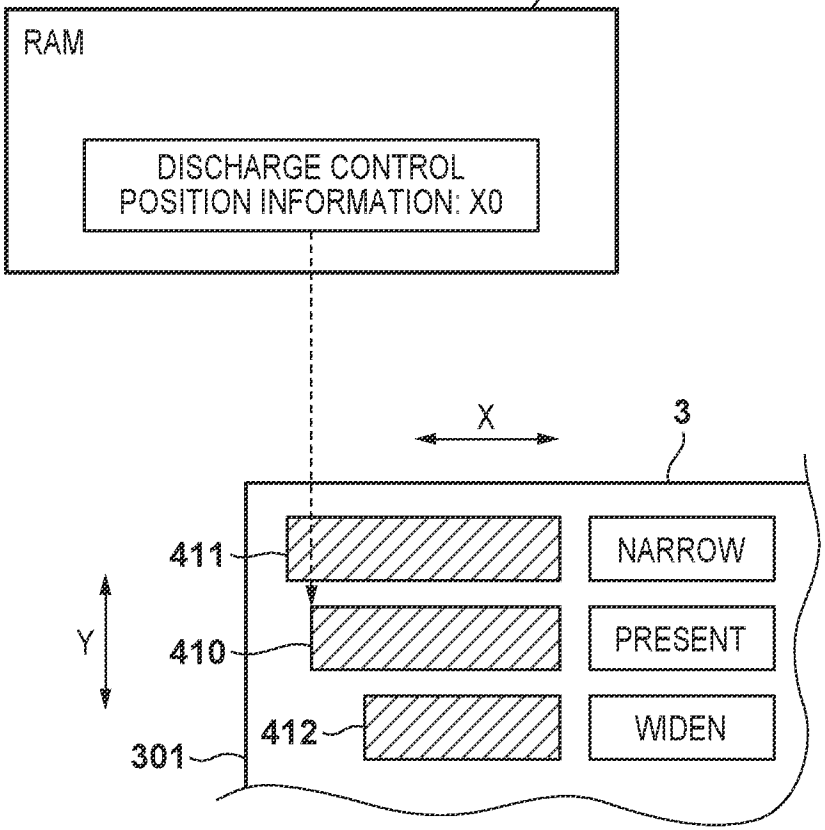

In the first embodiment, printing position calibration is performed based on a reading result on a test pattern or preceding printed portion which is obtained by the sensor unit 17. However, another calibration method can be also be used. FIGS. 16A and 16B are views for explaining this method. In the second embodiment, test control of printing a plurality of test patterns on a sheet 3 is executed, and the user is made to select a test pattern, thereby performing printing position calibration.

FIG. 16A shows an example of printing a plurality of test patterns 410 to 412. The respective test patterns differ in their distance settings to an edge 301 of the sheet 3 in the widthwise direction. In the example shown in FIG. 16A, the plurality of test patterns 410 to 412 are arranged in a sub-scanning direction Y. However, dot-like patterns may be arranged in a main scanning direction X.

The test pattern 410 is position information recorded as discharge control position information in a RAM 203, with X0 representing the position of an edge of an image on the edge 301 side. The discharge control position information X0 is a control distance setting with respect to an edge of the sheet 3. The test patterns 411 and 412 are printed, with the positions of edges of the images on the edge 301 side being shifted by a specified amount in the + and − directions with respect to the test pattern 410.

In this embodiment, identifiers corresponding to the test patterns 410 to 412 are printed adjacent to the test patterns 410 to 412. The identifier of the test pattern 410 is the word "present", which indicates a default setting. The identifier of the test pattern 411 is the word "narrow", which indicates that the margin amount is decreased. The identifier of the test pattern 412 is the word "widen", which indicates that the margin amount is increased.

The user visually checks the test patterns 410 to 412 printed on the sheet 3, selects one of them, and instructs the selection result to a printing apparatus 100. The user may instruct a selection result via a PC 200 or an operation panel 205.

FIG. 16B shows an example in which the selection result instructed by the user is the test pattern 411. The discharge control position information X0 stored in the RAM 203 is replaced with information corresponding to the—direction (a direction in which an edge of the image approaches the edge 301) in accordance with the test pattern 411. In this manner, a distance setting is selected in accordance with an instruction from the user.

When wanting to further perform adjustment, the user executes test pattern printing again. Repeating this operation will update discharge control position information to obtain a printing result favored by the user. Note that if ink is discharged outside of the sheet in the width direction in this calibration process, ink discharged onto the platen 2 may be wiped off after the calibration.

In image printing after calibration, the printing position of an image is controlled based on discharge control position information stored in the RAM 203 and the position of an edge of the sheet 3 which is detected by the sensor unit 17.

In this case, calibration is performed by letting the user select one of the test patterns 410 to 412. However, the user may be allowed to adjust discharge control position information in the + and − directions with respect to an actual printing result.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a continuation of U.S. patent application Ser. No. 15/258,904, filed on Sep. 7, 2016, which claims the benefit of Japanese Patent Application No. 2015-194404, filed Sep. 30, 2015, which is hereby incorporated by reference herein in its entirety.

What is claimed is:

1. A printing apparatus comprising:

a conveying unit configured to convey a sheet in a first direction;

a printhead configured to print an image on the sheet based on print data by discharging ink;

a platen configured to face the printhead and support the sheet;

a groove configured to be arranged on the platen so as to receive ink discharged from the printhead;

a determining unit configured to determine a location of an edge of the sheet in a second direction intersecting the first direction; and a control unit configured to change a discharging region based on a determination result of the determining unit, wherein, in borderless printing, the control unit is configured to control the printhead to discharge ink on a region within the sheet and including the edge of the sheet if the edge of the sheet in the second direction is not located on the groove.

2. The printing apparatus according to claim 1, further comprising a detection unit configured to detect the location of the edge of the sheet in the second direction, wherein the determining unit determines the location of the edge of the sheet based on a detection result of the detection unit.

3. The printing apparatus according to claim 1, wherein in the borderless printing, the control unit controls the printhead to discharge ink within and beyond the sheet if the edge of the sheet in the second direction is located on the groove.

4. The printing apparatus according to claim 1, further comprising a carriage configured to move in the second direction, wherein the printhead is mounted on the carriage.

5. The printing apparatus according to claim 4, further comprising a detection unit configured to detect the location of the edge of the sheet in the second direction, wherein the detection unit is mounted on the carriage.

6. The printing apparatus according to claim 4, wherein in the borderless printing, a moving distance of the carriage in the second direction in a case in which the edge of the sheet is located on the groove is longer than a moving distance of the carriage in the second direction in a case in which the edge of the sheet is not located on the groove.

7. The printing apparatus according to claim 1, wherein, in margin printing, print data is generated from image data so as to provide a set margin amount with respect to a size of the sheet.

8. The printing apparatus according to claim 1, wherein the control unit is configured to change a start position of the printing operation based on the position of the edge of the sheet.

9. The printing apparatus according to claim 8, wherein the control unit is configured to change the start position of the printing operation when a printing condition is changed.

10. The printing apparatus according to claim 9, wherein the printing condition includes at least one of:

a distance between the printhead and the sheet, a moving velocity of the printhead, and a suction pressure of a suction portion which is formed on the platen supporting the sheet and is configured to suction the sheet.

11. The printing apparatus according to claim 1, wherein the control unit is configured to perform the borderless printing according to a printing mode selected from a plurality of printing modes.

12. A printing apparatus comprising:

a conveying unit configured to convey a sheet in a first direction;

a printhead configured to print an image on the sheet based on print data by discharging ink;

a platen configured to face the printhead and support the sheet;

a groove configured to be arranged on the platen so as to receive ink discharged from the printhead;

a determining unit configured to determine a location of an edge of the sheet in a second direction intersecting the first direction; and a control unit configured to change a discharging region based on a determination result of the determining unit, wherein, in borderless printing, the control unit is configured to control the printhead to discharge ink so that discharged ink lands within but not beyond the sheet if the edge of the sheet in the second direction is not located on the groove.

13. The printing apparatus according to claim 12, further comprising a detection unit configured to detect the location of the edge of the sheet in the second direction, wherein the determining unit determines the location of the edge of the sheet based on a detection result of the detection unit.

14. The printing apparatus according to claim 12, wherein the control unit controls the printhead to discharge ink so that discharged ink lands within and beyond the sheet if the edge of the sheet in the second direction is located on the groove.

15. The printing apparatus according to claim 12, wherein, in micro-margin printing, a margin amount from the edge of the sheet in the second direction is controlled to 1.5 mm or less.

16. The printing apparatus according to claim 12, wherein the control unit is configured to perform the borderless printing according to a printing mode selected from a plurality of printing modes.

17. The printing apparatus according to claim 12, further comprising a carriage configured to move in the second direction, wherein the printhead is mounted on the carriage, and in the borderless printing, a moving distance of the carriage in the second direction in a case in which the edge of the sheet is located on the groove is longer than a moving distance of the carriage in the second direction in a case in which the edge of the sheet is not located on the groove.

18. A printing apparatus comprising:

a conveying unit configured to convey a sheet in a first direction;

a carriage configured to move in a second direction intersecting the first direction;

a printhead configured to be mounted on the carriage and to print an image on the sheet by discharging ink while the carriage moves in the second direction;

a detection unit configured to be mounted on the carriage and to detect a location, in the second direction, of an edge of the sheet, which has a predetermined width in the second direction; and a control unit configured to determine a start position of a printing operation associated with a position of the carriage in the second direction, wherein the control unit is configured to change the start position based on a detection result by the detection unit.

19. The printing apparatus according to claim 18, wherein the control unit is configured to change the start position of the printing operation when a printing condition is changed.

20. The printing apparatus according to claim 19, wherein the printing condition includes at least one of:

a distance between the printhead and the sheet, a moving velocity of the carriage, and a suction pressure of a suction portion which is formed on a platen supporting the sheet and is configured to suction the sheet.

21. The printing apparatus according to claim 18, wherein the detection unit detects an edge position of an image printed by the printhead.

22. The printing apparatus according to claim 21, wherein the control unit changes the starting position based on the position of the edge of the sheet and the position of the edge of the image which are detected by the detection unit.

23. The printing apparatus according to claim 18, wherein the control unit is configured to perform borderless printing according to a printing mode selected from a plurality of printing modes.

24. The printing apparatus according to claim 23, further comprising a platen configured to face the printhead and support the sheet, and a groove configured to be arranged on the platen so as to receive ink discharged from the printhead, wherein, in the borderless printing, a moving distance of the carriage in the second direction in a case in which the edge of the sheet is located on the groove is longer than a moving distance of the carriage in the second direction in a case in which the edge of the sheet is not located on the groove.

* * * * *